US009250029B1

(12) United States Patent
Moore

(10) Patent No.: US 9,250,029 B1
(45) Date of Patent: Feb. 2, 2016

(54) DETACHABLE ARTICLE WARMER

(76) Inventor: Christopher Snowden Moore, Newark, DE (US)

( * ) Notice: Subject to any disclaimer, the term of this patent is extended or adjusted under 35 U.S.C. 154(b) by 940 days.

(21) Appl. No.: 13/424,223

(22) Filed: Mar. 19, 2012

Related U.S. Application Data

(60) Provisional application No. 61/465,536, filed on Mar. 18, 2011.

(51) Int. Cl.
*F28F 21/06* (2006.01)
*A47K 10/06* (2006.01)
*E03C 1/00* (2006.01)

(52) U.S. Cl.
CPC ..... *F28F 21/065* (2013.01); *A47K 10/06* (2013.01); *E03C 2001/005* (2013.01)

(58) Field of Classification Search
CPC ..... A61F 7/0097; A61F 2007/0095; A61F 2007/0054; F28F 3/14; F28F 21/065; F24J 2/202; F24J 2/205; F24J 2/22; E03C 2001/005; A47K 10/06
USPC ..... 165/46, 185; 4/546, 597; 607/104
See application file for complete search history.

(56) References Cited

U.S. PATENT DOCUMENTS

| | | | | |
|---|---|---|---|---|
| 3,590,215 | A * | 6/1971 | Anderson et al. | 392/470 |
| 4,114,620 | A * | 9/1978 | Moore et al. | 607/104 |
| 4,498,446 | A * | 2/1985 | Judson | 123/557 |
| 4,684,787 | A | 8/1987 | Bunting | |
| 4,927,995 | A * | 5/1990 | Lovett et al. | 219/385 |
| 4,979,712 | A | 12/1990 | Rios | |
| 5,496,357 | A * | 3/1996 | Jensen et al. | 607/108 |
| 6,371,976 | B1 * | 4/2002 | Vrzalik et al. | 607/104 |
| 6,604,942 | B2 | 8/2003 | Sharp | |
| 7,198,093 | B1 * | 4/2007 | Elkins | 165/46 |
| 8,732,870 | B2 * | 5/2014 | Carl | A47K 10/06 4/546 |
| 2007/0079436 | A1 | 4/2007 | Na et al. | |
| 2007/0118194 | A1 * | 5/2007 | Mason et al. | 607/104 |
| 2007/0162096 | A1 * | 7/2007 | Zakuto et al. | 607/104 |
| 2008/0000021 | A1 | 1/2008 | Carl et al. | |
| 2008/0052816 | A1 | 3/2008 | Gillis | |
| 2009/0240312 | A1 * | 9/2009 | Koewler | 607/104 |

FOREIGN PATENT DOCUMENTS

| | | |
|---|---|---|
| EP | 2044873 | 4/2009 |
| GB | 2393636 A | 4/2004 |
| GB | 2407032 | 4/2005 |

* cited by examiner

*Primary Examiner* — Tho V Duong
(74) *Attorney, Agent, or Firm* — Invention To Patent Services; Alex Hobson

(57) ABSTRACT

An article warmer that is detachable to and from a faucet head and utilizes diverted water is provided. In one embodiment, the article warmer comprises a warming enclosure and a heat transfer portion that conducts heat from the diverted water to the article to be heated. The heat transfer portion may be incorporated into the wall of the enclosure or may partially disconnect from the enclosure, allowing the user to wrap articles to be warmed around the heat transfer portion. In another embodiment, the heat transfer portion is configured to form the warming enclosure. Insulating, temperature indicating, and water resistant materials may be used in the construction of the article warmer.

17 Claims, 18 Drawing Sheets

DETACHABLE ARTICLE WARMER

CROSS REFERENCE TO RELATED APPLICATIONS

This application claims the benefit of U.S. Provisional Patent Application No. 61/465,536; entitled DETACHABLE ARTICLE WARMER and filed on Mar. 18, 2011, which in incorporated by reference herein in its entirety. Where there are discrepancies between this and the provisional application, the present application will dominate.

BACKGROUND OF THE INVENTION

1. Field of the Invention

The invention relates to a detachable article warmer, and in particular, to a towel warmer that utilizes diverted water from a water conduit connected to a faucet head.

2. Background

After taking a shower or bath, many people find it desirable to use a heated towel for drying, or like to put on heated articles of clothing. There exist articles, fixtures and towel heaters that require electric power to operate heaters and/or fans or blowers. In addition, many article warmers comprise large bulky enclosures that take up valuable, and in most cases limited, floor or wall space in the bathroom. There exists a need for a detachable article warmer that is easy to install, requires no electrical power, uses space more efficiently, and can serve to provide additional storage.

SUMMARY OF THE INVENTION

The invention is directed to a detachable article warmer that utilizes heated water from a water conduit flowing to a faucet head. The article warmer in one embodiment is configured to be detachable, and when attached to a water source, diverts heated water through a heat transfer portion for warming an article such as a towel or clothing. In one embodiment, the article warmer comprises a flexible, deformable or non-rigid enclosure having heat transfer conduits configured into the wall of the warming enclosure, and/or arranged within the warming enclosure. In yet another embodiment, an article, such as a towel, may be wrapped, folded or rolled around a portion of the heat transfer conduit, or heat transfer portion. In some embodiments, the heat transfer portion may be folded or rolled to form a warming enclosure. In another embodiment, the article comprises a means to detachably attach a portion of the enclosure to a wall, and in some of these embodiments, the attachment means effectively seals a portion of the enclosure surface from free aft flow.

The diverting portion of the article warmer may comprise threaded attachment portions for connection to the conduit head. In one embodiment, a valve may be manipulated to control when, and how much water is diverted to the heat transfer portion or to a faucet head. In one embodiment, the article warmer comprises a faucet head, and in another embodiment, the article warmer, comprises one or more attachment portions, for the attachment of faucet heads. These and other preferred embodiments are further described herein.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide further understanding of the invention and are incorporated in, and constitute a part of this specification, illustrate embodiments of the invention, and together with the description serve to explain the principles of the invention.

DETAILED DESCRIPTION OF THE ILLUSTRATED EMBODIMENTS

Description of the Figures

Figure 1:
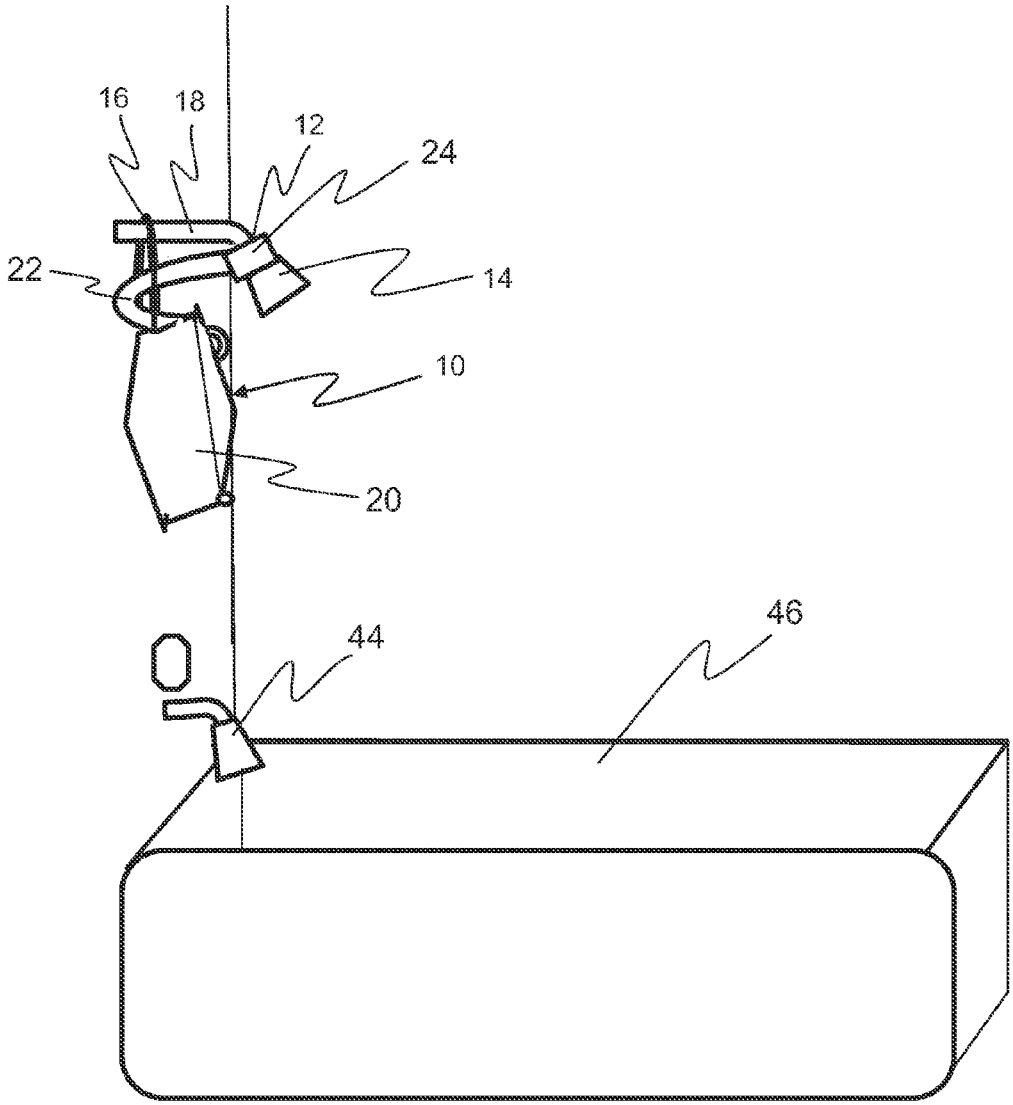

FIG. 1 shows an isometric view of an article warmer attached to a conduit head.

Figure 2:
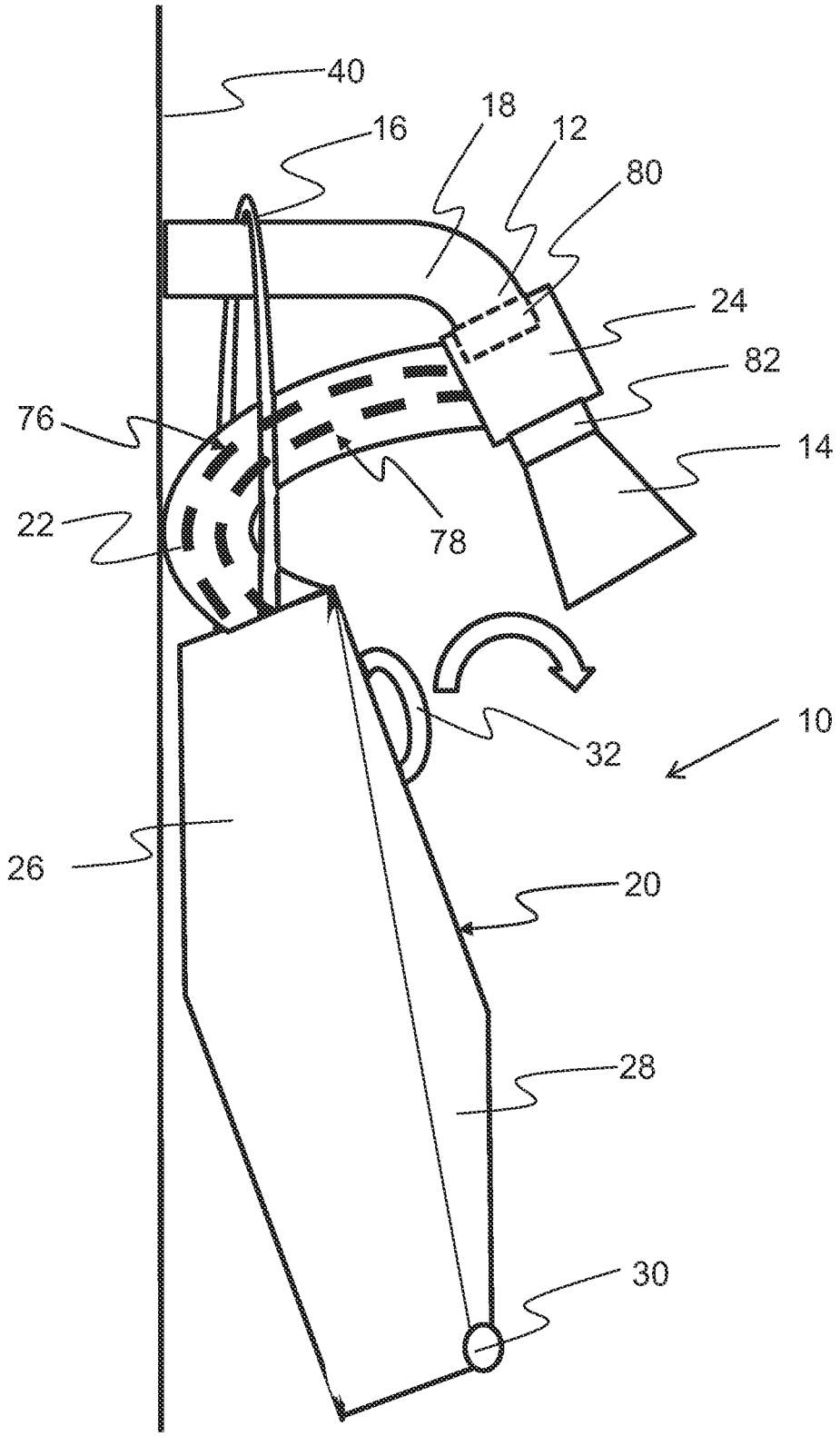

FIG. 2 shows a side view of an article warmer attached to a conduit head.

Figure 3:
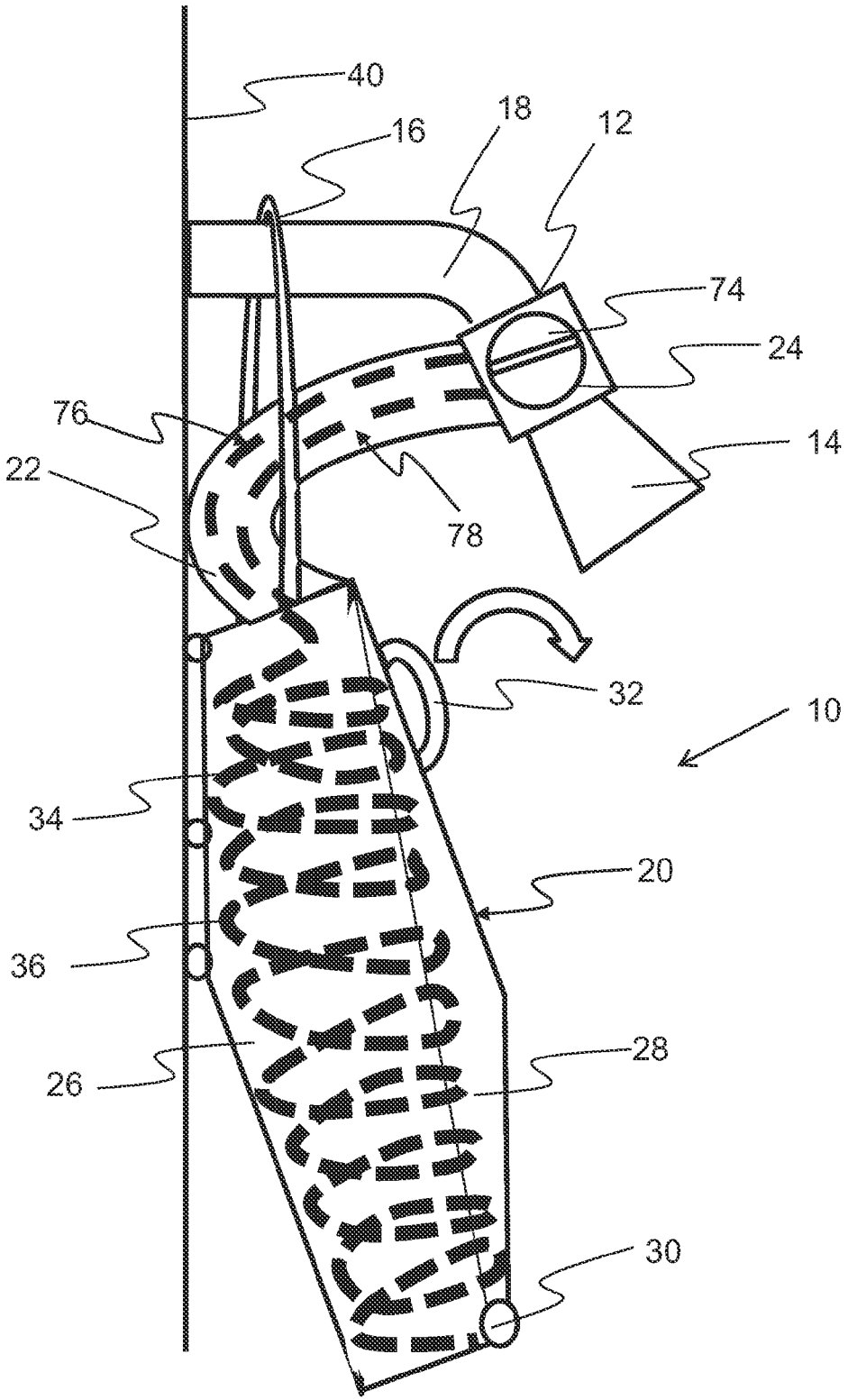

FIG. 3 shows a side view of an article warmer having a heat transfer portion and a valve for diverting water to the heat transfer portion.

Figure 4:
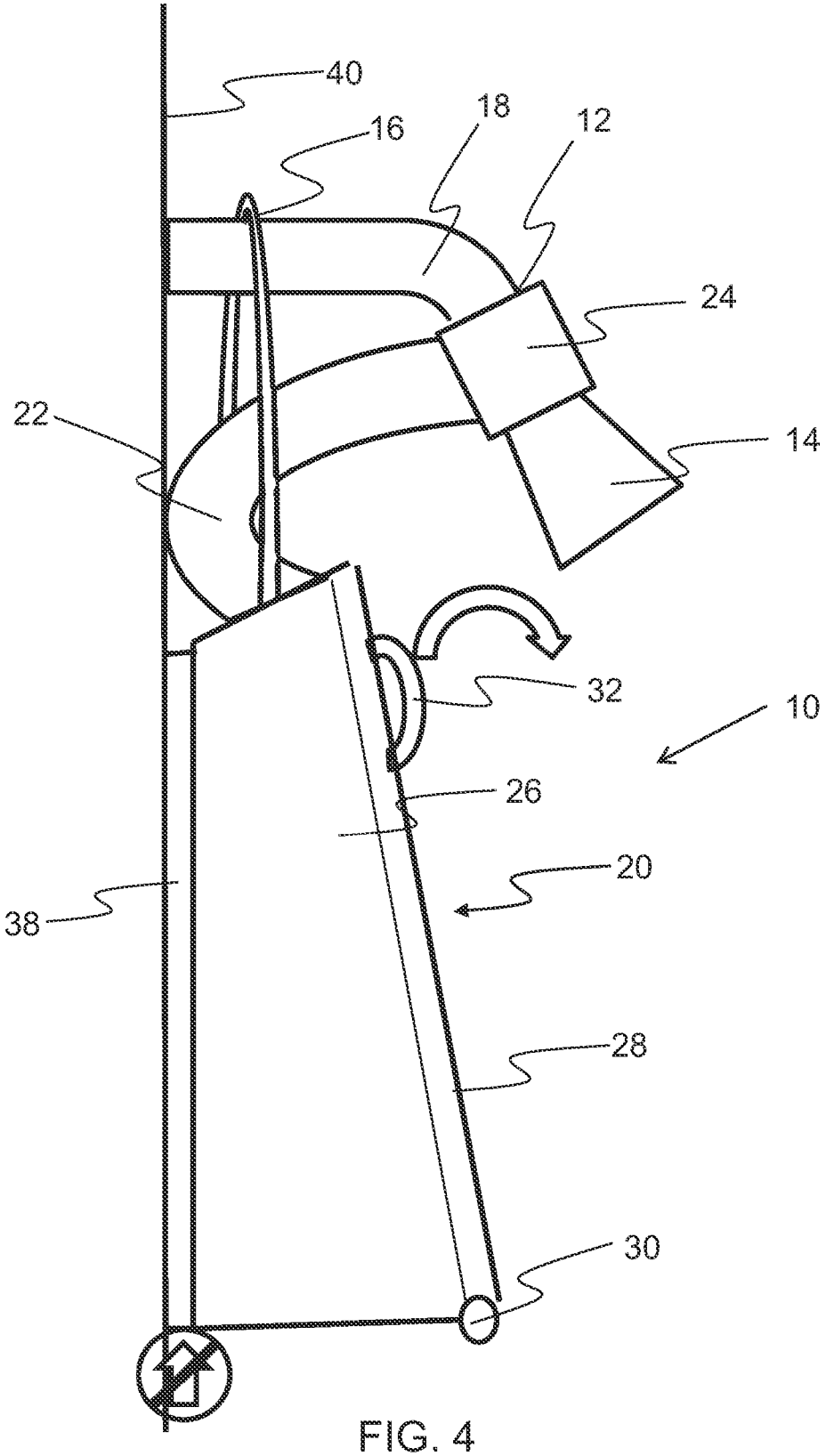

FIG. 4 shows a side view of an article warmer having a portion of the warming enclosure detachably attached to a wall.

Figure 5:
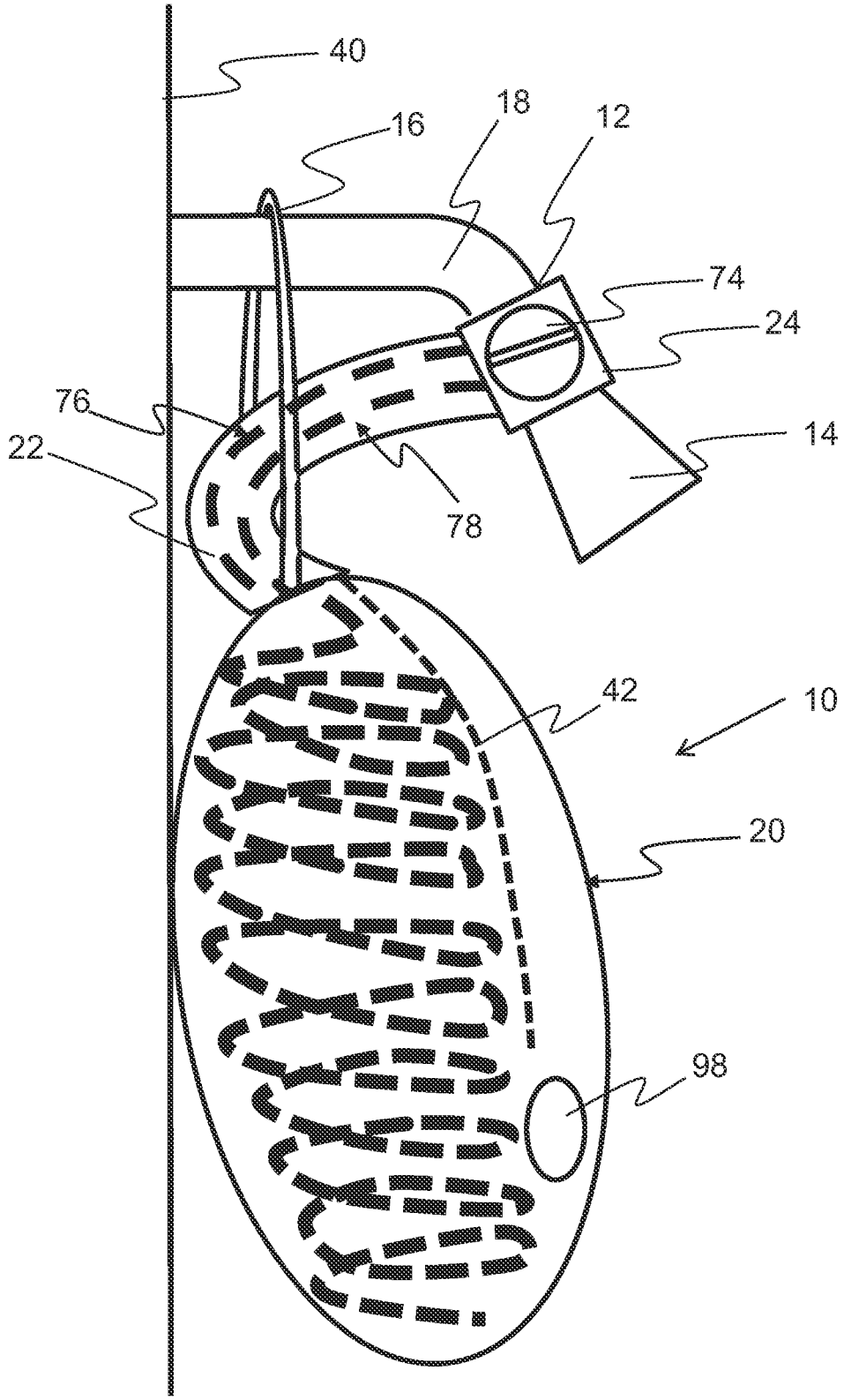

FIG. 5 shows a side view of an article warmer comprising a flexible enclosure.

Figure 6A:
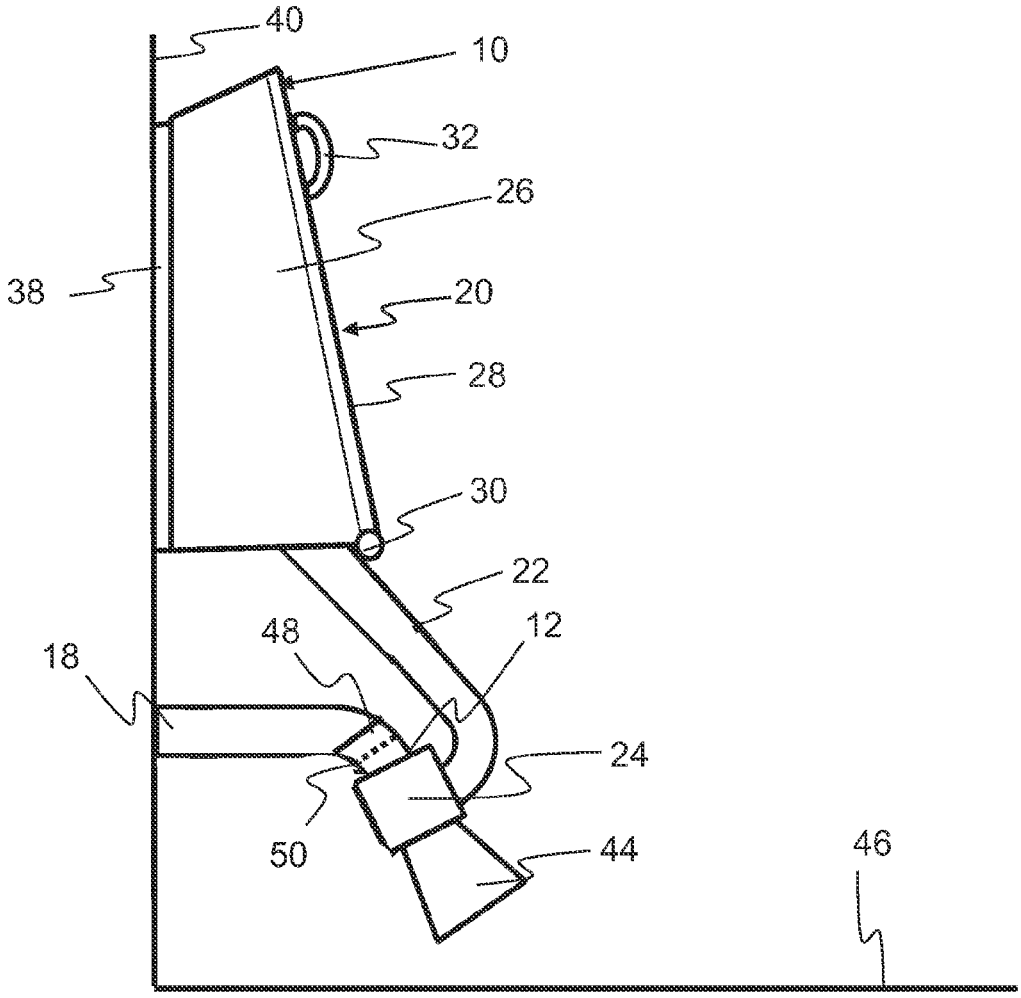

FIG. 6A shows a side view of an article warmer positioned above a tub faucet.

Figure 6B:
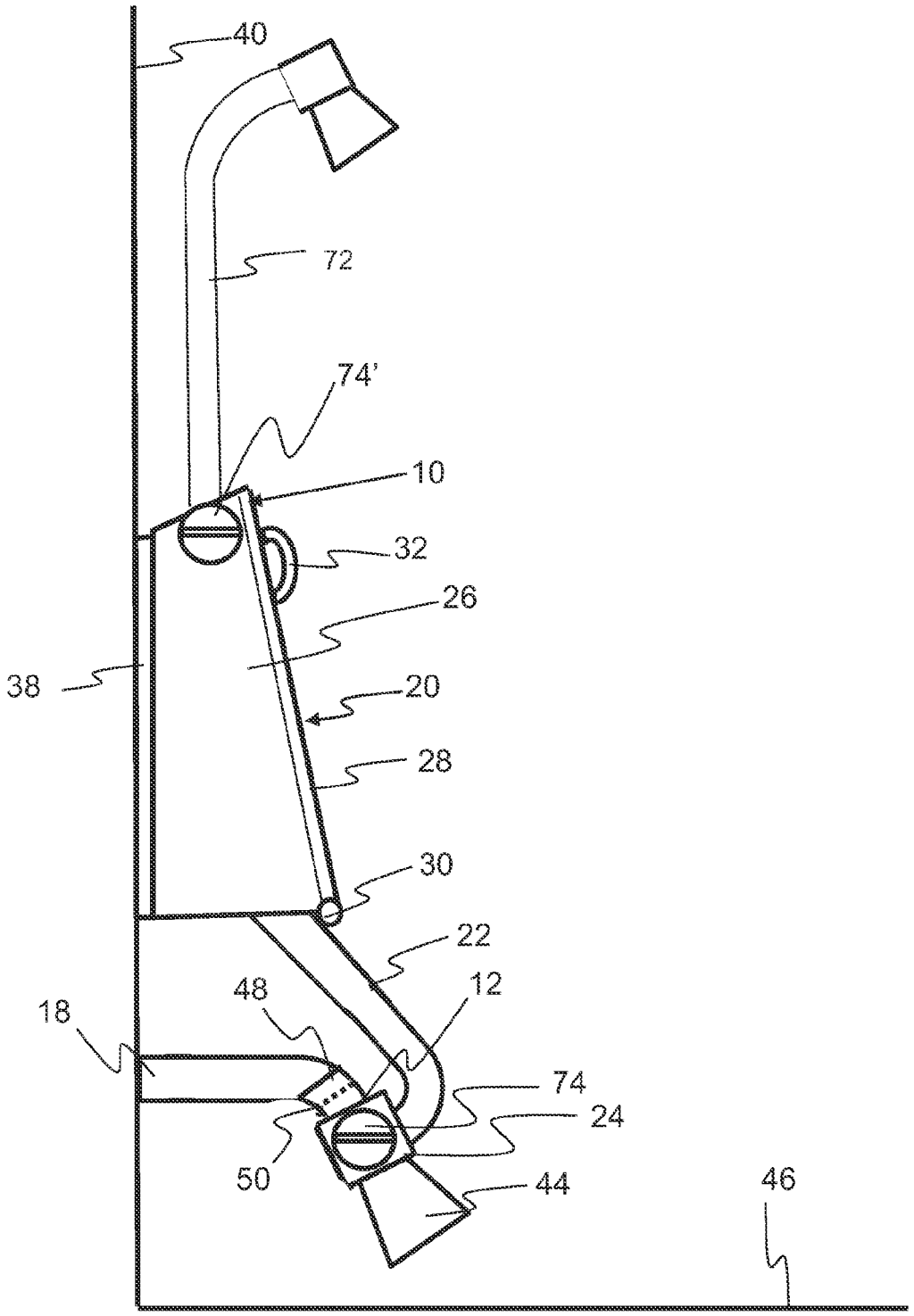

FIG. 6B shows a side view of an article warmer having two faucet heads, one attached to the diverting portion, and the other attached to the warming enclosure.

Figure 6C:
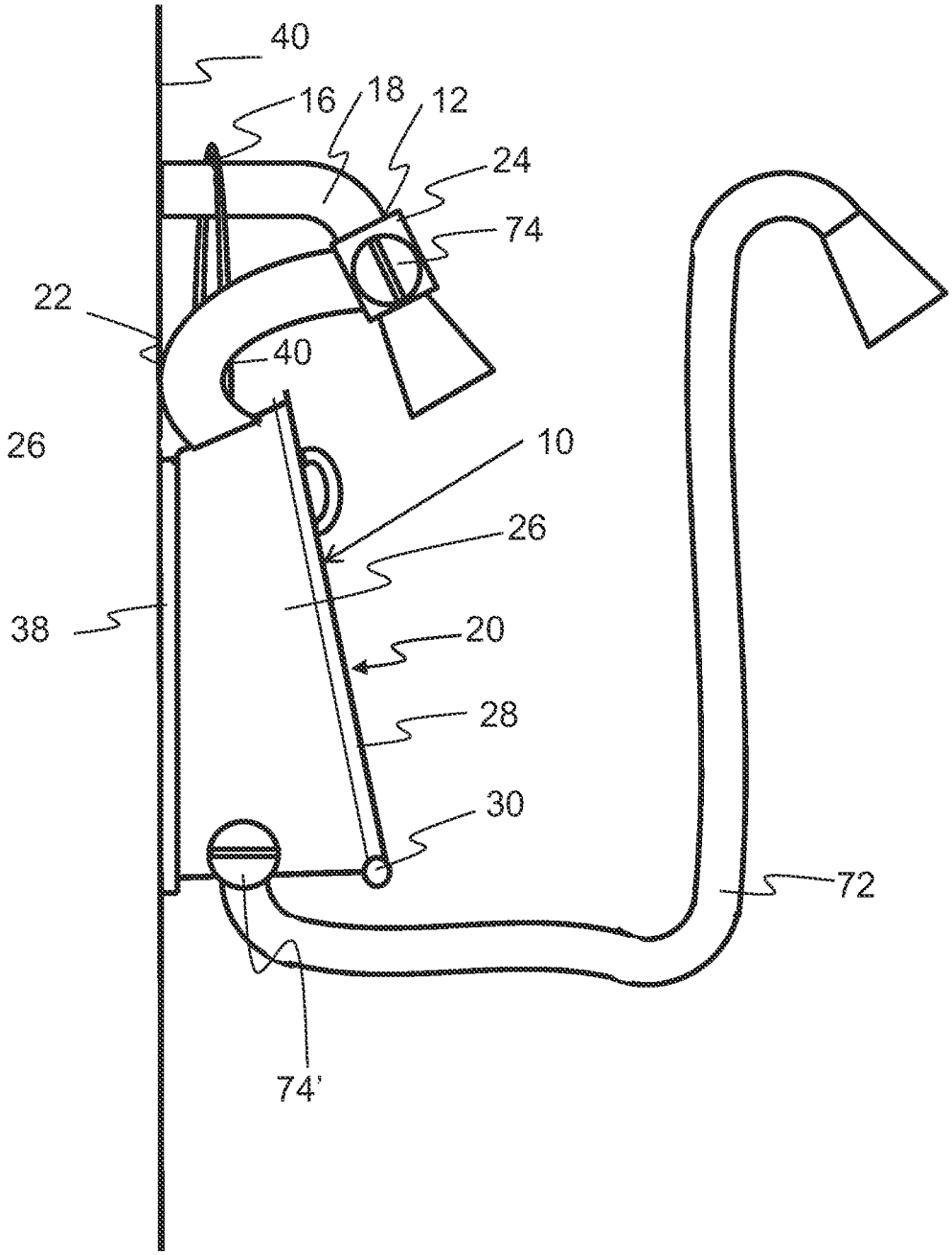
Figure 6D:
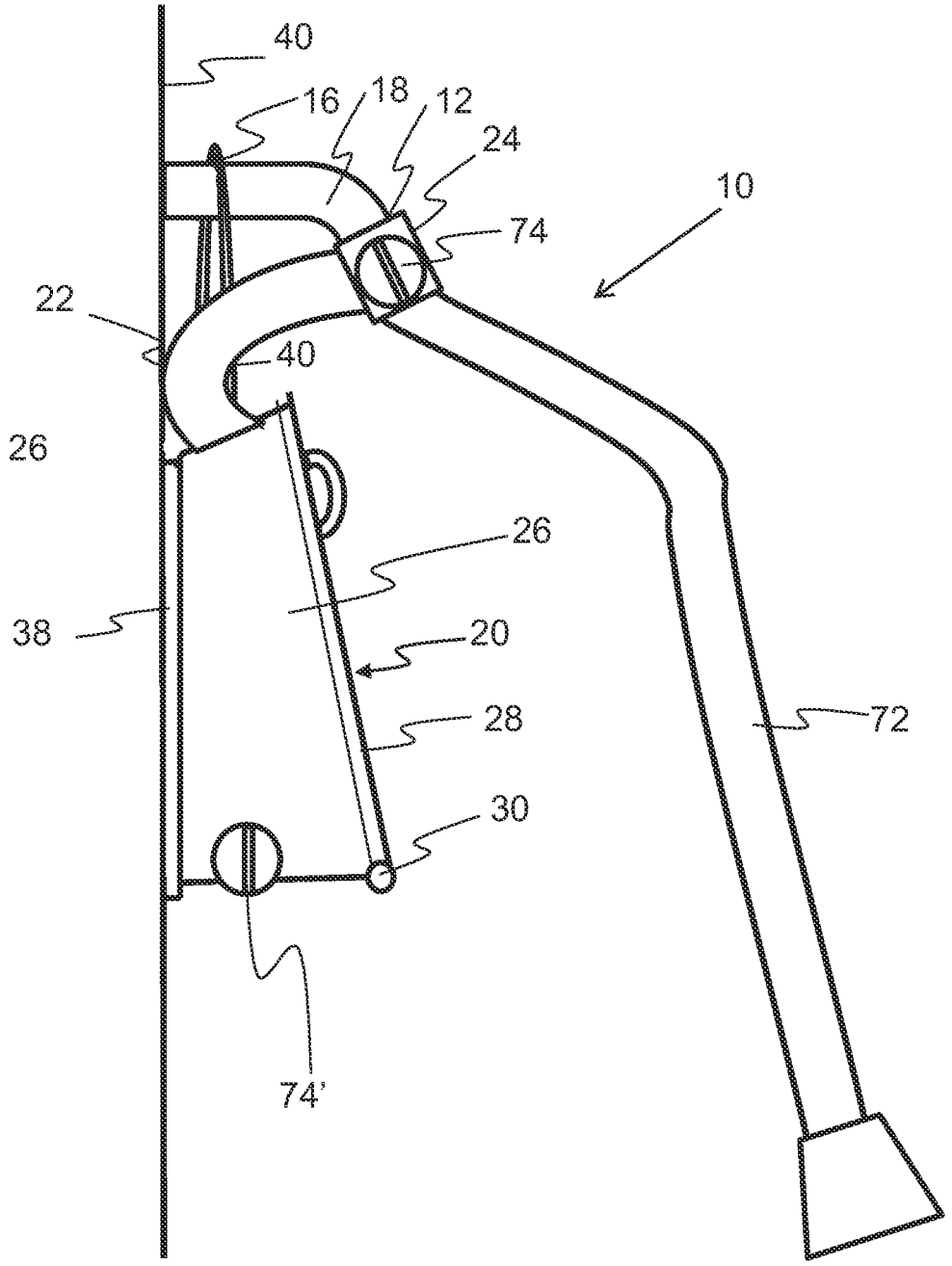
Figure 7A:
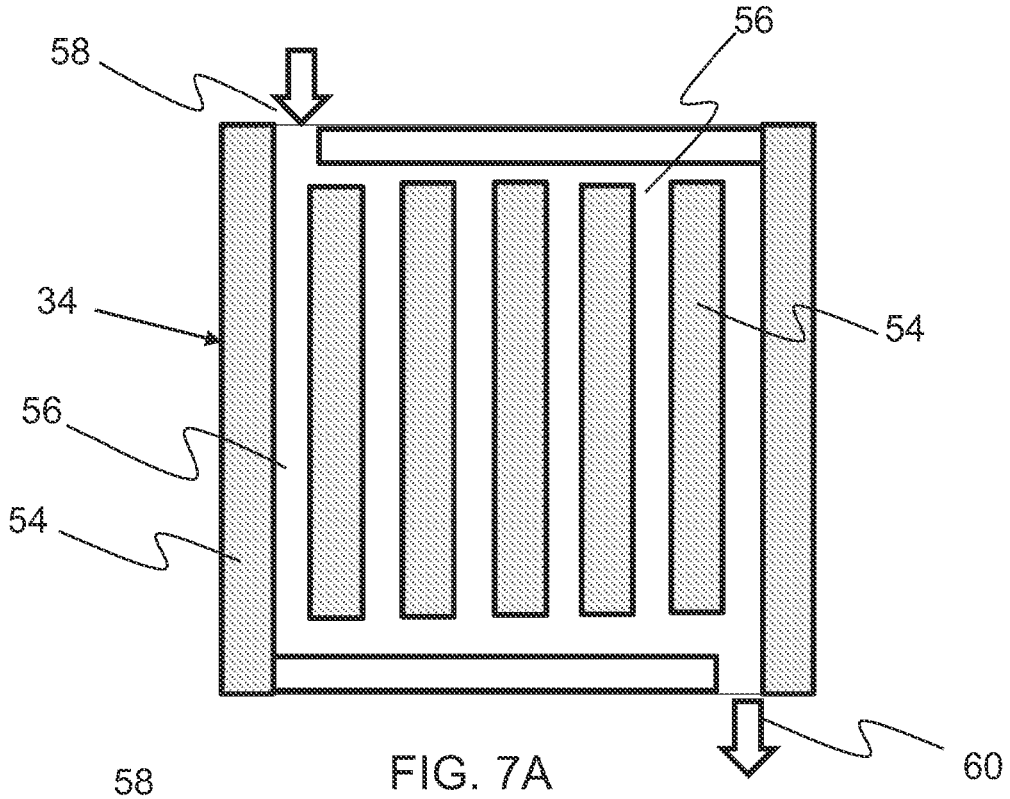
Figure 7B:
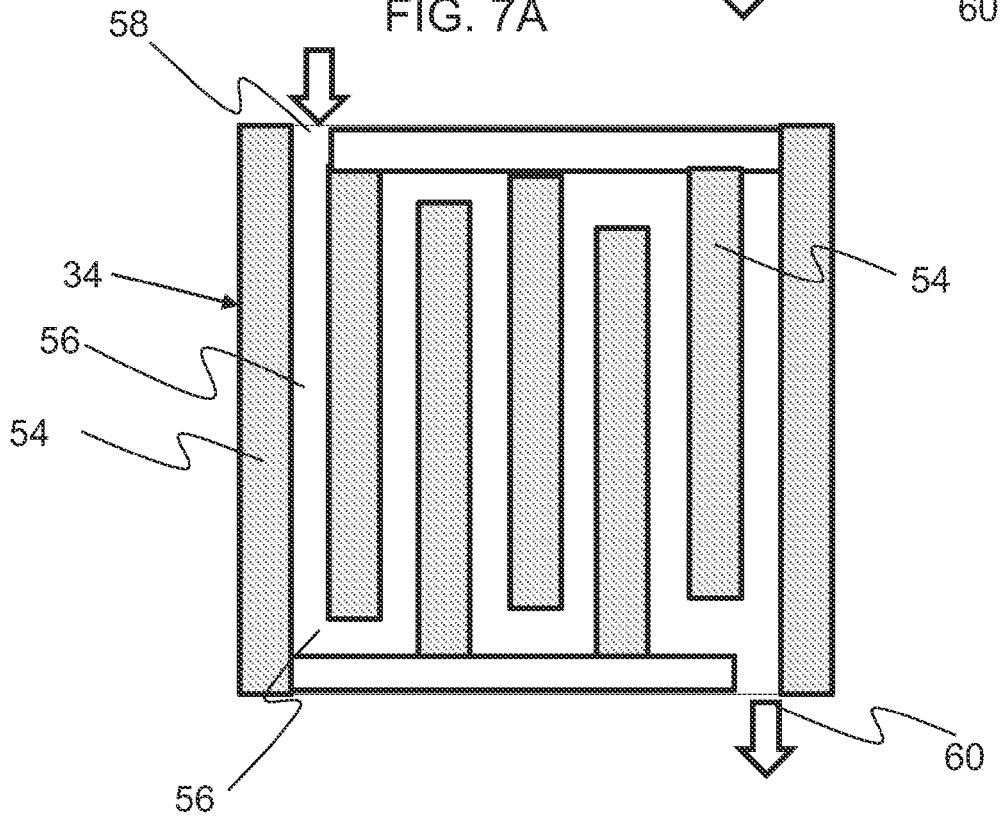
Figure 7C:
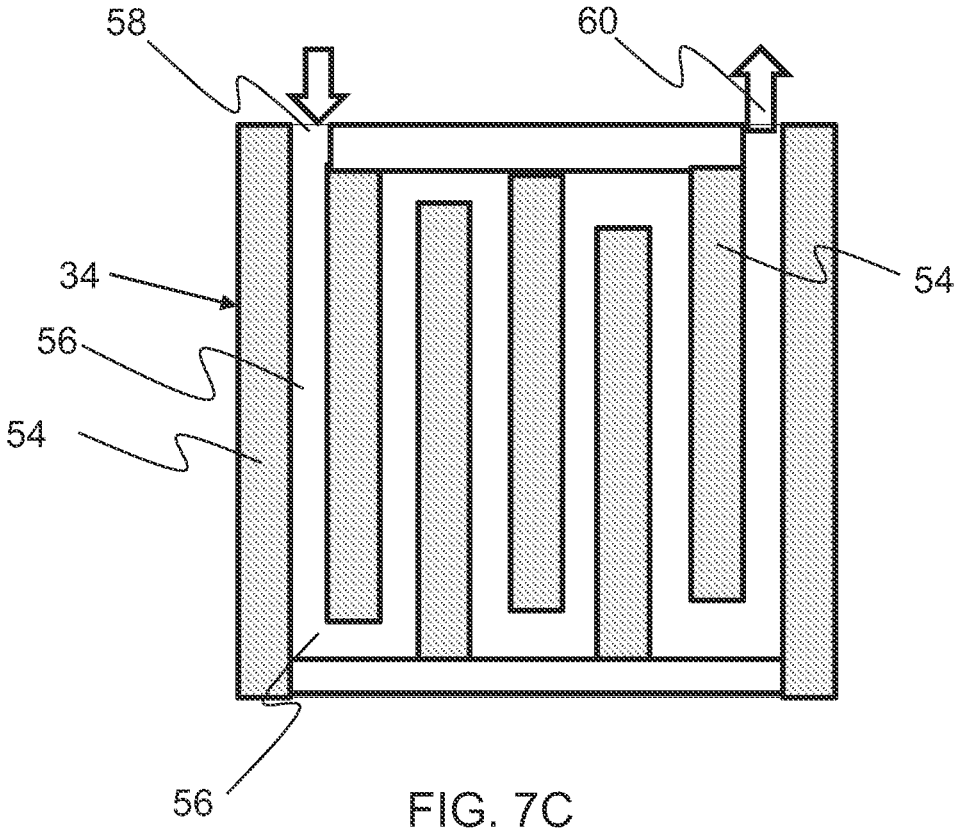

FIG. 6C shows a side view of an article warmer having a flexible faucet head extending from the warming enclosure FIG. 6D shows a side view of an article warmer having a flexible faucet head extending from the diverting portion FIG. 7A, FIG. 7B and FIG. 7C show liquid flow configurations.

FIG. 70 shows a cross sectional view of a portion of a heat transfer portion of the invention.

Figure 7D:
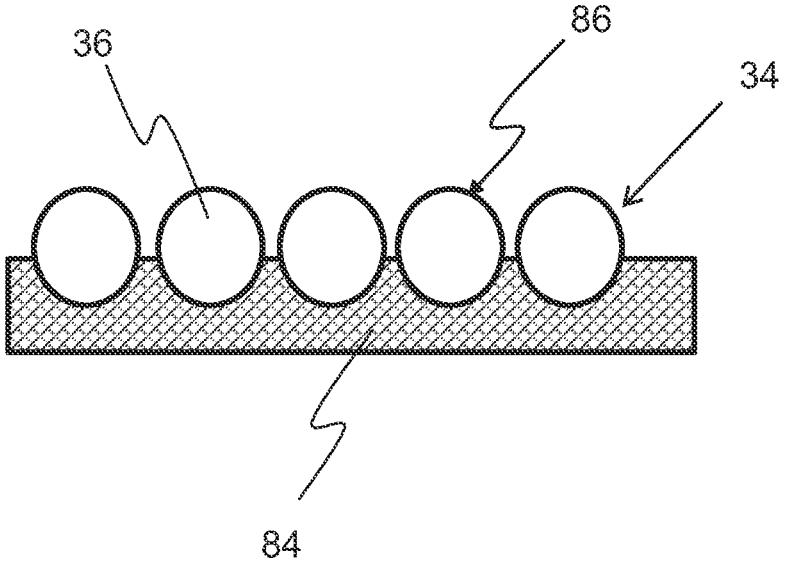
Figure 7E:
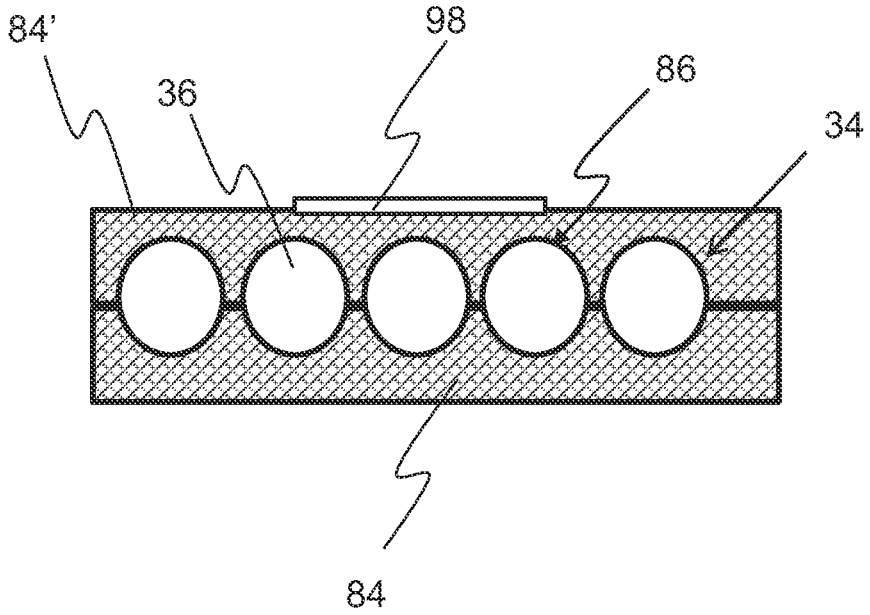

FIG. 7E shows a cross sectional view of a portion of a heat transfer portion of the invention.

Figure 8:
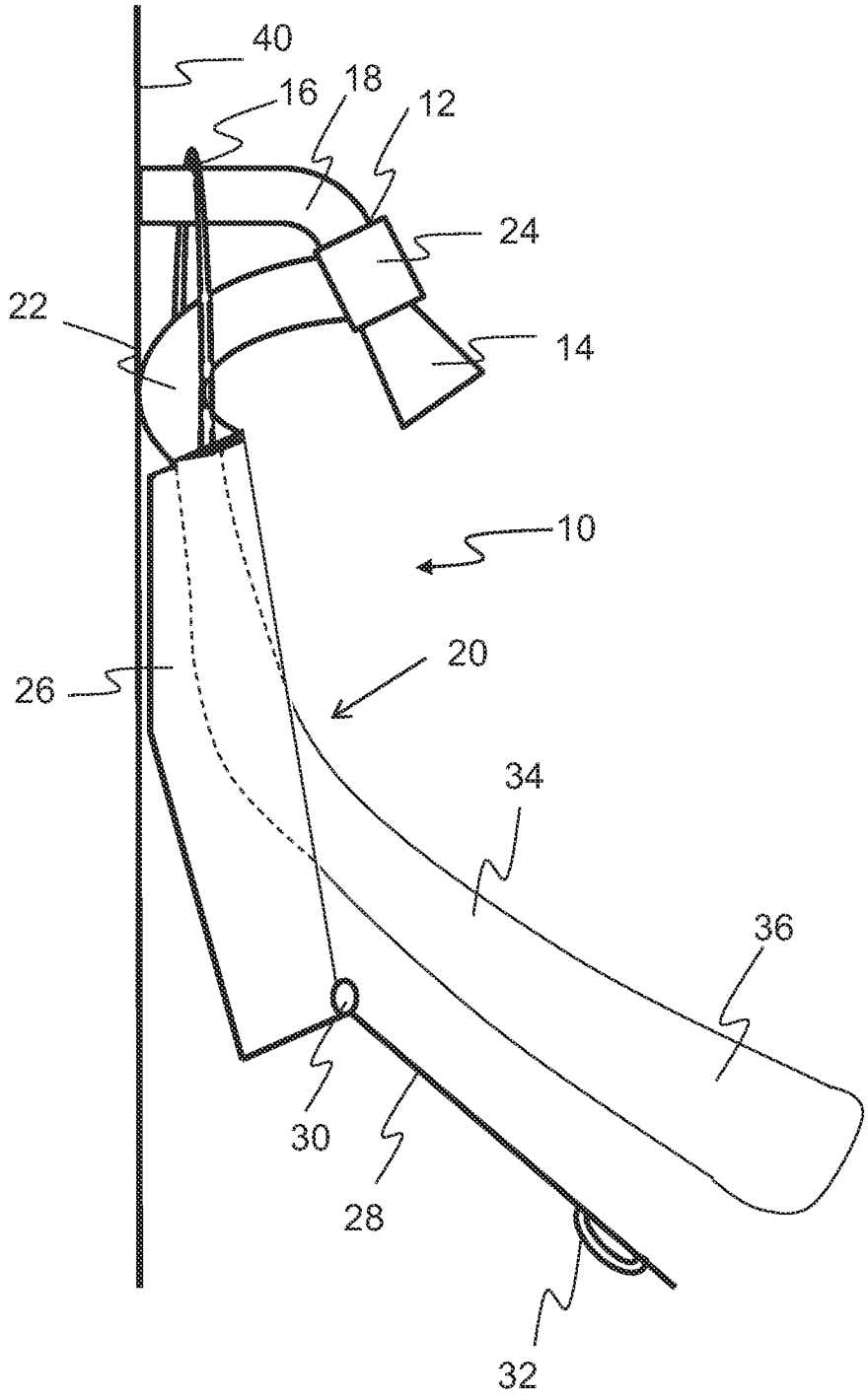

FIG. 8 shows a side view of an article warmer having a flexible heat transfer portion extended from the warming enclosure.

Figure 9:
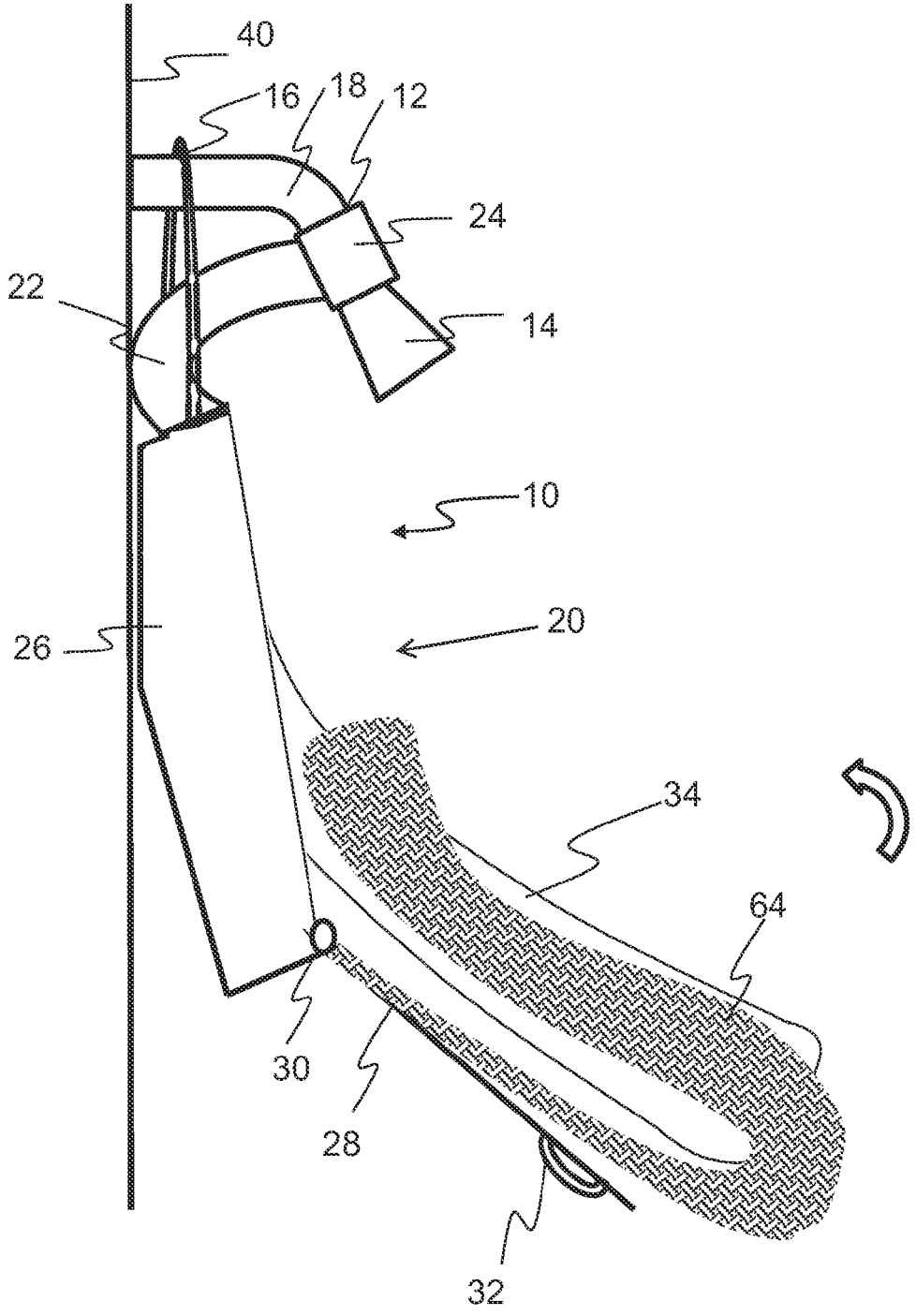

FIG. 9 shows a side view of an article warmer having a towel wrapped around a flexible heat transfer portion.

Figure 10:
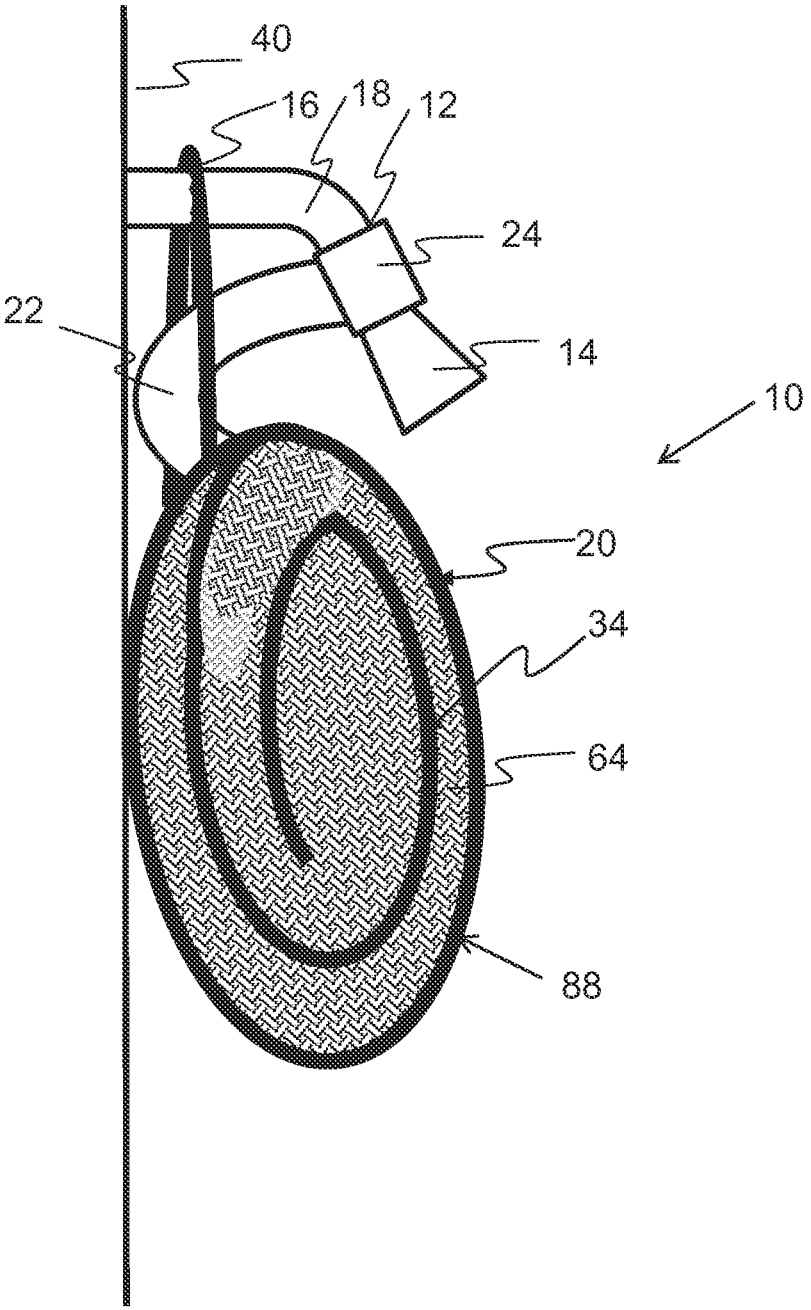

FIG. 10 shows a side view of an article warmer having a flexible warming enclosure comprising a flexible heat transfer portion in a jelly roll configuration.

Figure 11A:
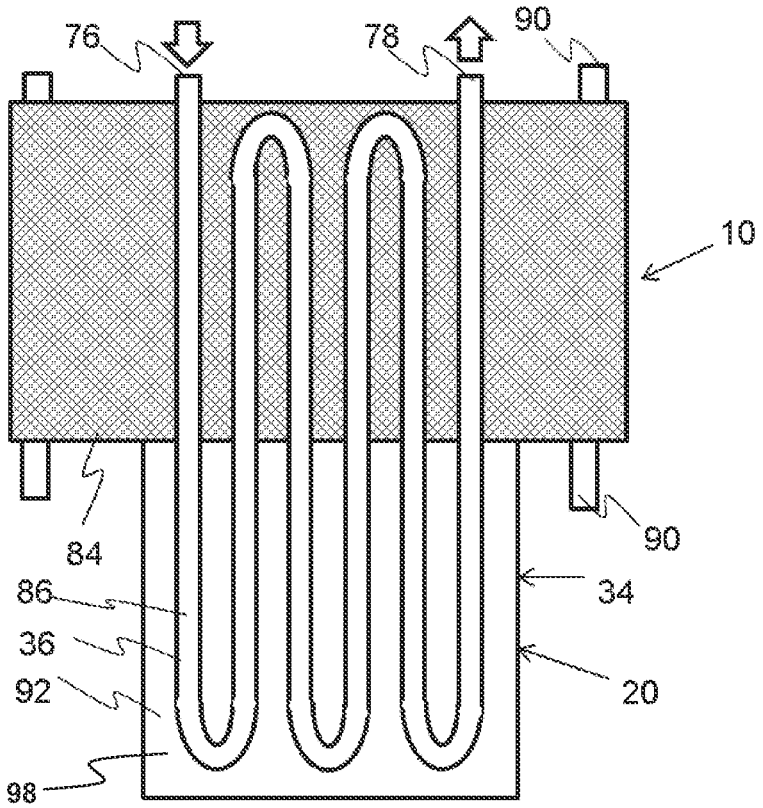

FIG. 11A shows a top down view of one embodiment of a heat transfer portion having a serpentine elongated tube heat transfer conduit, and extended ends having attachment features.

Figure 11B:
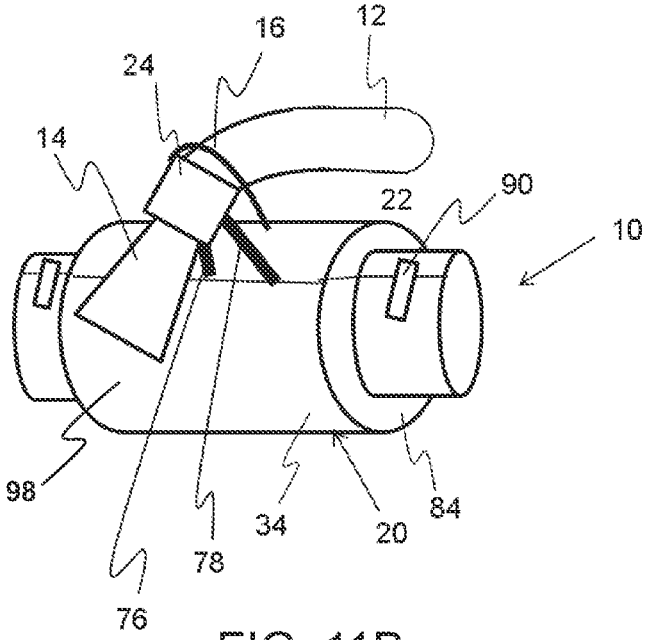

FIG. 11B shows an isometric view of the article warmer shown in FIG. 11A, rolled up and attached to a conduit head.

Figure 12A:
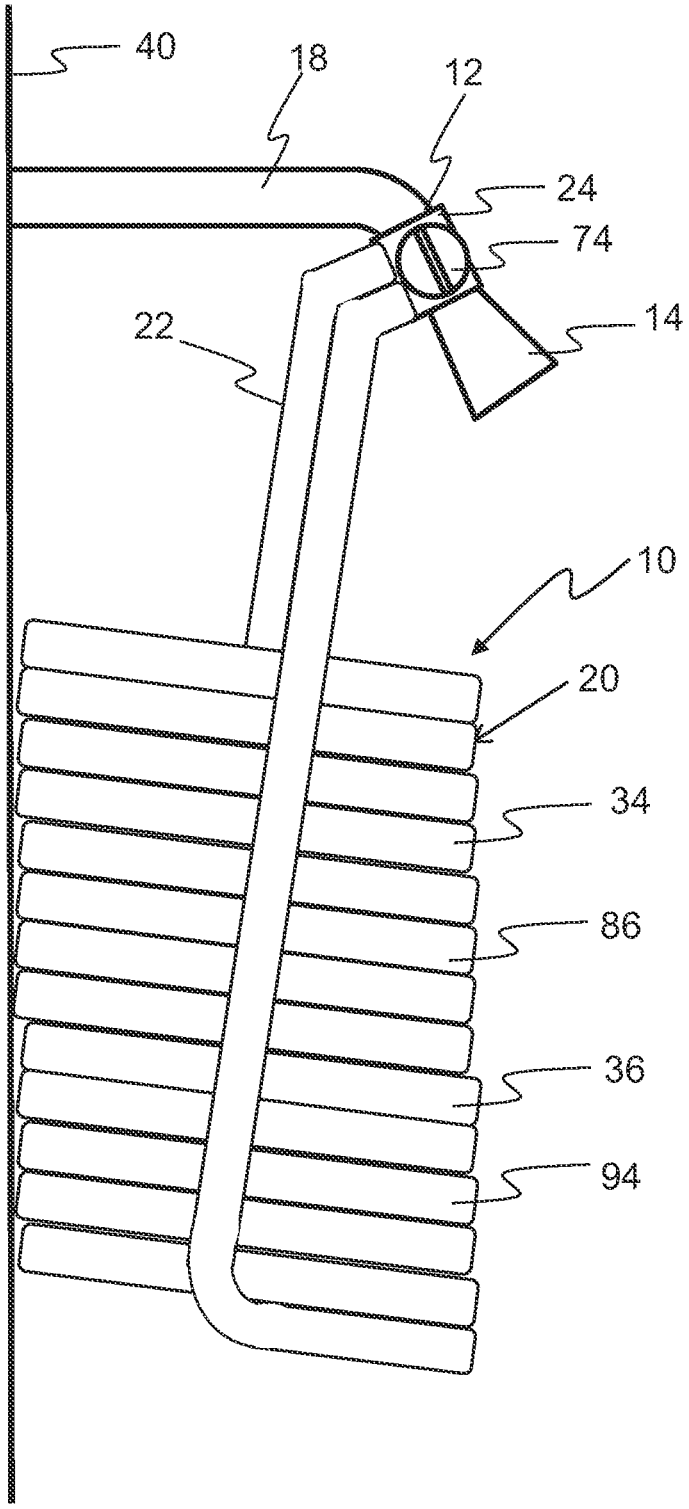

FIG. 12A shows a side view of an article warmer comprising a coil of tubing.

Figure 12B:
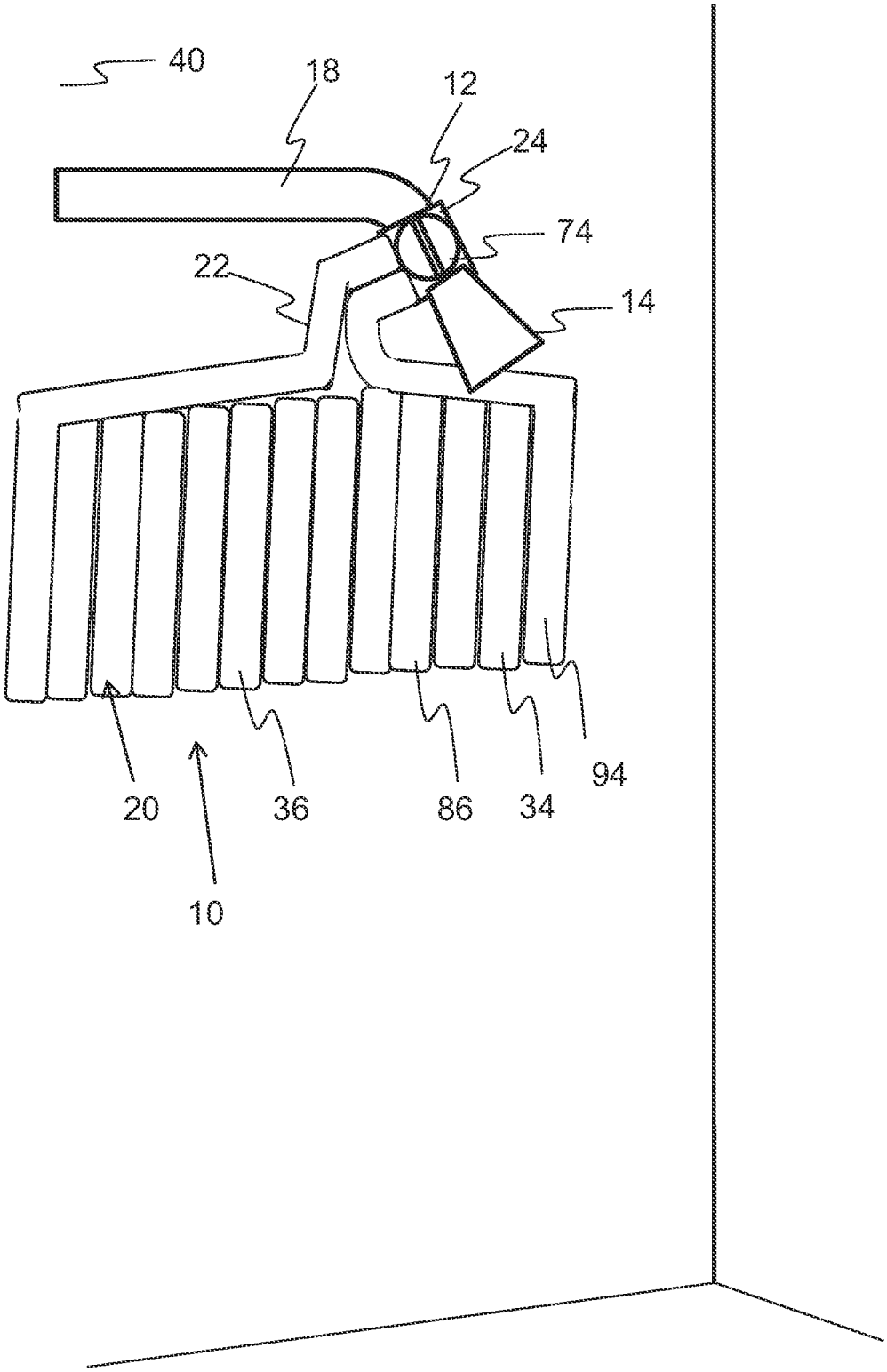

FIG. 12B shows an isometric view of an article warmer comprising a coil of tubing.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for describing some of the embodiments.

DETAILED DESCRIPTION

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

FIG. 1 depicts a typical shower and bath tub 46 arrangement common in many homes, having both a shower faucet head 14 and a tub faucet head 44. FIG. 1 depicts an embodiment of the present invention wherein the article warmer 10 is attached to a conduit head 12. As depicted, the article warmer 10 is attached between the water conduit 18 and the shower head 14, and is secured by the support 16 hanging over the water conduit 18. In this embodiment, a connecting portion 22 comprises a water conduit between the diverting portion 24 and the warming enclosure 20. The connecting portion may be flexible or rigid and may comprise one or more water conduits. In a preferred embodiment, the connecting portion comprises two water conduits, one to deliver warm water to the warming enclosure, and one to return the water from the enclosure. A flexible connecting portion comprising for example, flexible tubing, allows the warming enclosure to be positioned easily in various locations, such as from a shower curtain rod, the water conduit, or other support. In another embodiment, the warming enclosure or heat transfer conduit is connected directly to the diverting portion.

FIG. 2 depicts an enlarged view of the embodiment described in FIG. 1. The warming enclosure 20 in this embodiment is comprised of a first portion 26, second portion 28, hinge 30, and a handle 32 to open and close the enclosure. In this embodiment, the diverting portion 24 has treaded features 80 and 82 for attachment to the water conduit 18 and shower head 14. Most conventional shower water conduits 18 comprise male threads at the conduit head 12. In a preferred embodiment, the diverting portion comprises a first threaded feature 80 comprising female threads, for attachment to the water conduit 18, and a second threaded feature 82, for attachment of a shower head, as depicted in FIG. 2. In addition, as depicted in FIG. 2, the connecting portion comprises an outlet conduit 76 for water flow to the article warmer, and a return conduit 78, for the return of water from the article warmer. In one embodiment, a faucet head, such as a shower head or flexible faucet head or wand, is affixed to the article warmer of the present invention.

FIG. 3 depicts one embodiment of a heat transfer portion 34 comprising a heat transfer conduit 36 as part of the warming enclosure 20. The heat transfer conduit may be any suitable flow channel for transferring water and preferably comprises thermally conductive materials to provide adequate heat transfer and warming of the articles enclosed within the warming enclosure. In addition, FIG. 3 shows a user operative valve 74 for controlling the flow of water to the warming enclosure. The valve 74 may be manipulated to divert all, none, or only a portion of the water flowing through the conduit 18 to the warming enclosure 20.

FIG. 4 depicts another embodiment of the present invention, wherein the warming enclosure is attached by an attachment portion 38 to the wall 40. In one embodiment, the attachment portion 38 comprises at least one suction cup, that substantially seals a portion of the wall of the enclosure from free air flow. The suction cup, or cups may extend around at least a portion of the perimeter of the warming enclosure and detachably attach to the wall. Attaching a portion of the warming enclosure to the wall, may reduce heat loss by reducing free air flow over the attached surface. In addition, attaching the warming enclosure around the perimeter may further insulate the warming enclosure by minimizing the surface area of the enclosure in contact with the wall.

In another embodiment, the warming enclosure is detachably attached to a wall with devices made of two or more parts where one part is strongly attached to a wall 40, and the warming enclosure 20 comprises an attachment part configured to temporarily secure to the strongly attached part. For example, one or more anchors may be strongly attached to a wall, having an end extending from the wall wherein a bracket or hole in a warming enclosure can be located on the anchor for support. In another embodiment, the warming enclosure may be temporarily attached to a wall by hanging or attaching to a support element such as but not limited to a bolt, screw or the like.

FIG. 5 depicts yet another embodiment of the present invention, wherein the warming enclosure comprises a flexible material, having a linear opening feature 42 such as, but not limited to a zipper, hook-and-loop fastener, plastic zipper seal, or the like, or any combination thereof. In one embodiment, the warming enclosure consists essentially of a flexible bag, or bladder, having a linear opening feature. It is preferable that the warming enclosure be made of a water resistant material to prevent the contents from getting wet. In some embodiments, the warming enclosure comprises flexible material, such as, but not limited to woven and non-woven materials, plastic film, foams, coated fabrics, composite multilayer structures, any combination thereof, and the like. In one embodiment, the warming enclosure consists essentially of flexible material and in another embodiment, consists entirely of flexible material. In other embodiments, the warming enclosure comprises rigid, free standing materials, such as but not limited to, plastic, epoxy or metal sheets, foams, board, and any combination thereof.

In some embodiments, the warming enclosure comprises a temperature indicator 98, as depicted in FIG. 5 that provides a visual indication when subjected to changing temperature. The temperature indicator in one embodiment provides an indication of the temperature of the heat transfer fluid, and/or of the contents within the warming enclosure to alert the user when the contents within the enclosure have reached a desirable temperature. For example, the temperature indicator may change color such as from blue to red, when heated from room temperature to a temperature above 100 degrees Fahrenheit. In another embodiment, the temperature indicator comprises an alpha and/or numeric value display, such as those used in liquid crystal displays, including those used as fish tank thermometers having a series of temperatures that change color at a given temperature. In other embodiments, the temperature indicator comprises a digital display or comprises a dial that points to a temperature indicator such as alpha and/or numeric values. In one embodiment, a discrete temperature indicating material is incorporated into, or on the warming enclosure as depicted in FIG. 5, and in other embodiments, the temperature indicating material encompasses a larger portion of the outer area of the warming enclosure as depicted in FIGS. 11A and 11B, or makes up substantially all outer surface of the warming enclosure.

The conduit head of most showers have a threaded end where the shower head can be attached. Many tub faucet heads however, do not have a similar threaded end, or it may be desirable to retain the tub faucet head, and the diverting portion of the article warmer may be adapted to fit and seal over conventional tub faucet heads as depicted in FIG. 6A. In this embodiment, the diverting portion 24 is attached between the conduit head 12, and a separate tub faucet head 44, which may be part of the article warmer, or detachably attached to the diverting portion. In this embodiment, the warming enclosure 20 is attached to the wall 40 above the water conduit 18. In one embodiment, the diverting portion comprises an elastic collar 48 that can be slid over the end of conduit head, as depicted in FIG. 6A. A hose clamp 50 may also be used to further secure the elastic collar and prevent leaks. Any conventional means to attach the article warmer to the conduit head would be suitable. In one embodiment, a detachable slip-on method of attaching to an existing tub faucet is achieved by using a rubber, or elastomeric sleeve which can be slid over the faucet discharge to divert some, or all the water to flow to the article warmer. Clamps, ties or other methods may be used in conjunction with the elastomeric slip-on type connection to reduce or prevent leakage. Furthermore, some tub or showers have both cold and hot water conduit heads, and in these cases it may be beneficial to attach the article warmer to the hot water conduit head.

In another embodiment, as depicted in FIGS. 6B and 6C, the article warmer 10 is connected to a conduit head 12, and a flexible faucet head 72 is connected to the article warmer 10. In this configuration, the article warmer can be used to provide an additional faucet head that may be used for showering. A valve 74 or valves 74' may be incorporated into the article warmer 10 to divert water through the article warmer and then to the flexible faucet head as depicted in FIG. 6B, FIG. 6C and FIG. 6D. A valve may be used to divert all, or a portion of the flow of water from the water conduit to the article warmer and/or the flexible faucet head. In one embodiment, one valve is used to divert water from the diverting portion to the article warmer and a second valve 74 is used to divert water to a flexible faucet head. As depicted in FIG. 6C, the article warmer 10 may comprise a diverting portion 24 that diverts all of the water first, to the warming enclosure 20, and then to a faucet head 72. As depicted in FIG. 6D, the article warmer comprises a flexible faucet head attached to the diverting portion, and two valves 74 and 74'.

The warming enclosure can be made of any suitable material but is preferably made of a material that will readily shed water and will be durably resistant to repeated exposure to water and resistant to shower cleaning chemicals, as well as mold or mildew. In one embodiment, the warming enclosure comprises two or more portions that are hinged, allowing for easy placement and removal of articles. The article warmer may provide for the storage of items such as, but not limited to toothpaste, shampoo or other hair products, brushes, and the like. The article warmer may have pouches, pockets, slots, bins and the like, on the inside or outside of the warming enclosure wherein these items may be stored.

In another embodiment, the warming enclosure consists essentially of a flexible material such as but not limited to, plastic sheet, metal foil, metalized plastic sheet material, foam, woven or nonwoven material, composites, or any combination thereof. It is preferred to have high thermal conductivity from the heat transfer conduit to the interior of the warming enclosure or to the article to be warmed. In embodiments where the heat transfer conduit is within the wall of the warming enclosure, the wall of the warming enclosure may include metallic materials such as but not limited to metal foil, metal sheet, or metalized plastic. In addition, thermally insulating materials are desirable on the exterior of the warming enclosure to prevent heat loss. As described herein, in one embodiment, at least a portion of the wall of the warming enclosure is attached to a wall, therein insulating the open area between the wall and warming enclosure wall from free air flow and improving heat management.

Energy absorbing materials may also be added to the materials of construction, or built into the warming enclosure or heat transfer portion or heat transfer conduit, which would act as a heat sink, wherein it would absorb energy from the heat transfer fluid and release it into the article to be warmed. Temperature indicating materials 98, including but not limited to digital thermal tapes, thermo-chromic materials or films, and/or color changing indication materials may also be used in the article warmer to indicate temperature changes as shown in FIG. 7E. A numeric display of the temperature, or alpha characters and/or words may also be incorporated into or on the article warmer.

The heat transfer conduit may be a tube, such as an elongated tube, located within the warming enclosure wall or may be located within the enclosure. In another embodiment the heat transfer conduit may be an integral part of the enclosure wall, and may be formed from two sheet materials attached to form conduits there between. In another embodiment, the heat transfer conduit comprises flow channels formed from molded, including injection molded, cast, thermoformed, or otherwise formed materials including vacuum formed sheets. In a further embodiment, the heat transfer conduit comprises tubing that is coiled and placed inside a structure or attached together to form the enclosure.

In one embodiment, as depicted in FIGS. 7A, 7B and 7C, the heat transfer portion 34 comprises two layers of material having adhered regions 54, depicted by the cross-hashed areas, that create a sealed volume or flow channels 56 between the layers, and an inlet 58 and outlet 60 for permitting water flow. As depicted in FIG. 7A, the adhered regions 54 are configured to create a sealed volume, or flow channels 56 in a manifold configuration, whereas in FIGS. 7B and 7C, the adhered regions are configured to create serpentine flow channels 56. A flow channel may be an elongated flow channel, or an elongated sealed volume, wherein the length of a channel is at least two times the average width of the channel. In FIG. 7C the inlet 58 and outlet 60 are on the same side of the heat transfer portion 34. A wide variety of flow designs have been envisioned, including but not limited to a pouch or bladder having discrete adhered regions in a random pattern, a dot or discontinuous pattern, a linear pattern and the like. The flow channel configuration depicted and described herein could also be designed into a molded, cast, or formed heat transfer conduit. The layers of materials used to create flow channels having adhered regions, may include any suitable material, including but not limited to, elastomers, rubber, thermoplastics, thermoset materials, composite, or metal sheets, metalized plastic sheets, metal foil, metal foil having an adhesive or thermoplastic layer, composites, and any combination thereof. It is preferable to construct the bonded layer flow channels out of thin materials, wherein a layer of material is less than 10 mm, 8 mm, 5 mm, 4 mm, 3.5 mm, 2 mm, 1 mm, 0.5 mm, 0.25 mm or 0.125 mm thick, or between 0.125 mm and 5 mm, 0.125 and 2.5 mm, 0.1255 and 1 mm, or 0.5 and 5 mm thick.

The heat transfer portion may be incorporated into the wall of the warming enclosure, or may in one embodiment, make up at least a portion of the warming enclosure. In one embodiment, the heat transfer conduit may comprise a flexible material that can be rolled, folded or otherwise formed to create a warming enclosure.

In one embodiment, the heat transfer portion 34 comprises a tube or series of tubes that may be configured to form a ribbon of tubes as depicted in FIG. 7D. In the cross sectional view of the heat transfer portion 34 in FIG. 7D, tubes 86 for carrying the water, and acting as a heat transfer conduit 36, are configured together by being attached to an insulating material 84. In a very simple configuration, a single tube is configured in a serpentine or other manner and attached to an insulating material such as a sheet of urethane foam. In this configuration, the tube having a first and second end could be attached to the diverting portion or connecting portion. This configuration may be flexible such as when thin wall plastic tubes are used, or rigid, such as when metal pipe or tubing are used.

In another embodiment, the heat transfer portion 34 comprises a tube or series of tubes that may be configured to form a ribbon of tubes as depicted in FIG. 7E where the tube or tubes are arranged between two layers of material, 84 and 84'. In addition, FIG. 7E shows a temperature indicating material 98 attached to the heat transfer portion 34.

As depicted in FIG. 8, the heat transfer portion 34 may comprise flexible material that may be extended from the enclosure. This configuration of the heat transfer conduit would allow for a large contact surface area. The heat transfer conduit in this configuration may comprise a pouch, a pouch having flow channels, injection molded flow channels, conduit tubes, and the like. A towel 64 or other article may be wrapped around the heat transfer portion 34 and then folded or rolled into the warming enclosure 20, as depicted in FIG. 9. In yet another embodiment, the article warmer 10 may comprise a flexible heat transfer portion 34 that can be wrapped around the article to be warmed to create a "jelly roll" 88 configuration, as depicted in FIG. 10. The ends may be exposed, or covered by the extended flexible material ends. In this configuration, the warming enclosure consists essentially of the heat transfer portion comprising a heat transfer conduit. A portion of the outer surface of the heat transfer conduit may comprise a thermally insulating material, such that the exposed outer portion is insulated, when in the "jelly roll" configuration. Any number of sealing and attachment means for the "jelly roll" configuration have been envisioned including but not limited to, hook and loop assemblies, snaps, clips, straps, buttons, zippers and the like.

A flexible heat transfer portion 34 is shown if FIG. 11A where a serpentine tube 86 is configured and attached to an insulating material 84 and a connecting material 92. The connecting material can be any suitable material that can connect the tubes and keep them in their general configuration, and may be a sheet, net, or simply a strap or series of straps. In one embodiment, no connecting material is used and the tubes attached to the insulating material effectively keep their general configuration. An article such as a towel may be wrapped around the heat transfer portion in such a manner that the heat transfer portion can be rolled or folded to at least partially enclose the towel, as depicted in FIG. 11B; leaving the insulating material exposed on the outside surface. Attachment features 90, such as, hook-and-loop fasteners, may then be used to gather and seal the extended ends of the insulating material to form the warming enclosure 20. The tube 86, or heat transfer conduit 36, may be connected to the diverting portion by the outlet conduit 76 and return conduit 78. This configuration is also easy for cleaning as the entire warming enclosure can be quickly and easily disconnected from the diverting portion and rinsed and washed. It is further envisioned, that the detachable enclosure could be temporarily removed from the water conduit and cleaned with the use of a scrub brush, garden hose, power washer, or even by placing the article heater, or parts of the article heater into a dishwasher for easy cleaning.

In one embodiment, the article warmer 10 may comprise a coil of tubing 94 that defines an interior volume for receiving the article to be warmed as depicted in FIGS. 12A and 12B. A coil of tubing may be attached along a portion of the connecting surfaces, such as with an adhesive or by welding, or a connecting material may enclose at least a portion of the coil. The coil of tubing may be flexible to allow for stretching and accommodating of larger articles to be warmed. In one embodiment, the coil of tubing comprises a plastic tube, that can be stretched to make the coil longer, or stretched to increase the interior volume diameter. In yet another embodiment, a flexible warming enclosure may cover the coil to prevent water ingress into the interior volume, while allowing for stretching of the coil of tubing. In still another embodiment, the coil of tubing comprises a cover or other barrier over only a portion, such as over the top of the interior volume. In a preferred embodiment, as depicted in FIGS. 12A and 12B, the coil of tubing 94 is configured to create the warming enclosure 20, and is the heat transfer portion 34. The tube 86 may further connect to the diverting portion 24 and provide the outlet and inlet conduit, as well as the connecting portion, as depicted in FIGS. 12A and 12B. A valve 74 may also be incorporated into the article warmer 10, as depicted in FIGS. 12A and 12B.

DEFINITIONS

As used herein, the term article, in reference to the article to be warmed by the article warmer of the present invention, includes, but is not limited to, a towel or article of clothing that may be used after bathing to dry off or keep warm. A towel may be of any size that will fit inside the enclosure and an article of clothing, includes but is not limited to, a robe, pants, shirt, socks, suppers, undergarments, hat and the like.

Bathing includes both showering and taking a bath.

Conduit head, as used herein, refers to the end of a water conduit, pipe, or tubing that extends typically into a shower or bath, and in many cases comprises a connecting portion having threads for connecting a faucet head, including a shower head, tub faucet head, shower wand, or flexible faucet head adaptor, and the like.

Detachable, as used herein, in reference to the article warmer, means that the article warmer can be removed by hand from the conduit head and from any attachments to the wall, and that it is not permanently affixed, such as through the use of permanent fixing material such as solder, weld, bolts, nails, and the like.

Faucet head, as used herein, refers to the end through which water flows through for the purpose of bathing, and includes but is not limited to a shower head, faucet, tub faucet head, or flexible faucet head, shower wand, spray device, or flexible faucet adaptor.

Jelly roll, as used herein in reference to the article warmer, heat transfer portion, or heat transfer conduit, means that an article to be warmed is at least partially rolled up within the material.

Valve, as used herein, means a user operable valve that can be manipulated by hand, and includes a user interface including but not limited to, a lever, a knob, a switch, a button, and the like.

Consists essentially of, in reference to the type of material the warming enclosure is made of, means that the enclosure body or shell is made of a particular type of material, however the enclosure may have a hinge, handle and the like, that are made of a different type of material.

Elongated tube, as used herein, is a tube having a length that is at least four times longer than the tube width or diameter. An elongated tube may have any suitable cross-sectional shape including, but not limited to round, square, oval and the like. Likewise, the opening of the tubing, or the conduit for water flow, may have any suitable cross-sectional shape, including, but not limited to, round, square, oval and the like.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

I claim:

1. An article comprising a detachable towel or garment warmer comprising:

a) warming enclosure;

b) water diverting portion connected to a shower conduit head for receiving a flow of water; and c) a flexible heat transfer portion connected to the water diverting portion and extending to an extended end and comprising a flow channel comprised of two layers of material having adhered regions there between, wherein a flow of diverted water from the diverting portion flows through the flow channel, d) a faucet head attached to the diverting portion and coupled with the flow channel of the heat transfer portion to receive said flow of diverted water from the flexible heat transfer portion, wherein the flexible heat transfer portion is configured to be folded or rolled around a portion of said towel or garment and placed completely inside of the warming enclosure.

2. The article of claim 1, further comprising a connecting portion comprising a water conduit between the diverting portion and the flexible heat transfer portion.

3. The article of claim 1, wherein the diverting portion comprises at least one threaded portion.

4. The article of claim 1, wherein the diverting portion comprises a first threaded portion connected to the shower conduit head and a second threaded portion connected to the faucet head.

5. The article of claim 1, wherein the warming enclosure consists essentially of plastic.

6. The article of claim 1, wherein the two layers of material are plastic sheets.

7. The article of claim 1 wherein the adhered regions are configured to produce serpentine flow channels.

8. The article of claim 1 wherein at least a portion of the two layers of material comprises a metal foil.

9. The article of claim 1 further comprising a means to attach the warming enclosure to a wall.

10. The article of claim 1 wherein the diverting portion comprises a valve.

11. The article of claim 1 further comprising a temperature indicator.

12. The article of claim 11 wherein the temperature indicator comprises a color change material.

13. The article of claim 11 wherein the temperature indicator comprises a numeric display.

14. An article comprising a detachable towel or garment warmer comprising:

a water diverting portion connected to a shower conduit head for receiving a flow of water and having a user operable valve; and a flexible heat transfer portion connected to the water diverting portion and extending to an extended end and comprising a flow channel comprised of two layers of material having adhered regions there between, wherein a flow of diverted water flows through the flow channel, a faucet head coupled to the diverting portion and coupled with the flow channel of the heat transfer portion to receive said flow of diverted water from the flexible heat transfer portion;

wherein the flexible heat transfer portion is configured to be folded or roiled around a portion of said towel or garment.

15. The article of claim 14, wherein the two layers of material are plastic sheets.

16. The article of claim 14, wherein at least a portion of the heat transfer portion is configured into a jelly roll.

17. The article of claim 16, wherein a warming enclosure consists essentially of the flexible heat transfer portion configured into a jelly roll;

where in use, an article to be warmed is wrapped within said jelly-roll.

* * * * *